US005261220A

United States Patent [19]

Stahlecker

[11] Patent Number: 5,261,220

[45] Date of Patent: Nov. 16, 1993

[54] SPINNING MACHINE HAVING A PLURALITY OF SPINNING STATIONS ARRANGED NEXT TO ONE ANOTHER

[75] Inventor: Fritz Stahlecker, Bad Überkingen, Fed. Rep. of Germany

[73] Assignee: Hans Stahlecker, Fed. Rep. of Germany

[21] Appl. No.: 847,312

[22] Filed: Mar. 6, 1992

[30] Foreign Application Priority Data

Mar. 20, 1991 [DE] Fed. Rep. of Germany ..... 4109110

[51] Int. Cl.[5] ..... D01H 13/28

[52] U.S. Cl. ..... 57/308

[58] Field of Search ..... 57/308, 315, 304

[56] References Cited

U.S. PATENT DOCUMENTS

| | | | |
|---|---|---|---|
| 2,431,726 | 12/1947 | Bechtler | 57/308 X |
| 2,946,173 | 7/1960 | Bahnson | 57/308 X |
| 3,217,483 | 11/1965 | Kato et al. | 57/308 X |
| 3,378,998 | 4/1968 | Shackelford | 57/308 X |
| 3,391,528 | 7/1968 | Shackelford | 57/308 X |
| 3,469,385 | 9/1969 | Tsuzuki | 57/90 X |
| 3,564,829 | 2/1971 | Tsuzuki | 57/90 X |
| 4,107,910 | 8/1978 | Fürstenbeng et al. | 57/308 |
| 4,357,793 | 11/1982 | Gasser et al. | 57/308 X |
| 5,157,910 | 10/1992 | Artzt et. al. | 57/308 |

FOREIGN PATENT DOCUMENTS

| | | |
|---|---|---|
| 2045006 | 4/1971 | Fed. Rep. of Germany . |
| 2544643 | 4/1977 | Fed. Rep. of Germany . |
| 3919284 | 12/1990 | Fed. Rep. of Germany . |
| 1183208 | 3/1970 | United Kingdom . |

*Primary Examiner*—Joseph J. Hail, III

*Attorney, Agent, or Firm*—Evenson, McKeown, Edwards & Lenahan

[57] ABSTRACT

At least one air-conditioning duct is provided which extends in the longitudinal direction of a spinning machine of the type including drafting devices. The air-conditioning duct is provided with outlet openings for air-conditioned fluid flows disposed such that the fluid flows penetrate the drafting devices. Preferably, an air-conditioning duct which both machine sides have in common is arranged below the drafting devices in the area of the machine center. Preferably, the fiber material, also for ring spinning machines, is fed in the form of slivers which are placed in cans which are deposited on a platform above the spinning machine.

16 Claims, 8 Drawing Sheets

SPINNING MACHINE HAVING A PLURALITY OF SPINNING STATIONS ARRANGED NEXT TO ONE ANOTHER

BACKGROUND AND SUMMARY OF THE INVENTION

This invention relates to a spinning machine having a plurality of spinning stations arranged next to one another which each have a drafting device and to which preferably one can respectively is assigned which contains sliver to be spun, as well as having at least one air-conditioning duct which extends in the longitudinal direction of the machine and is provided with outlet openings for air-conditioned fluid flows.

A spinning machine of this type is disclosed in the German Patent Document 39 19 284 A1. In the case of this known spinning machine, according to FIGS. 5 and 6, an air-conditioning duct is provided which extends below the drafting units (opening devices) in the longitudinal direction of the machine, and the outlet openings of which are directed against the slivers deposited in the cans. By means of this measure, only the spinning material is air-conditioned so that the energy expenditures for the air-conditioning can be kept minimal. However, the introduction of the air-conditioning fluid flows into the cans will be disadvantageous when a longer transport path for the slivers exists between the cans and the drafting units. In this case, before reaching the spinning units, the fiber material would be impaired such by the ambient inside air that the air-conditioning would be lost again even before the spinning.

From the British Patent Document GB-PS 11 83 208, a ring spinning machine is known to which slivers are fed in cans which are deposited on a platform above the ring spinning machine. The slivers to be fed to the drafting units are guided downward from the platform by means of sliver tubes. Between the drafting units and the platform, an air-conditioning duct extends in the longitudinal direction of the machine which is penetrated by the sliver tubes. Inside the air-conditioning duct, the walls of the sliver tubes are perforated so that the slivers are air-conditioned before the drafting units are reached. Also in this embodiment, the slivers, after their air-conditioning, have to cover a long path to the drafting units where the air-conditioning is required so that the danger exists that the air-conditioning will be lost again.

On the basis of the German Patent Document DE-AS 25 44 643, a double-twist frame is known in which, in the machine center above the double-twist spindles, an air-conditioning duct extends in the longitudinal direction of the machine. On both machine sides, the air-conditioning duct is equipped with blow nozzles through which air-conditioned air is fed to each spindle in the upper part of the yarn balloon. The arrangement is such that air-conditioned air always sweeps over particularly the feeding spool. However, no drafting devices exist in the case of a double-twist frame.

From the German Patent Document DE-OS 20 45 006, it is known to extend one compressed-air duct respectively along the opening rollers of the drafting devices of open-end rotor spinning machines which removes the fibers from the mounting of the opening roller and guides them to a spinning rotor. The compressed air fed to the opening roller is air-conditioned, in which case it is not specified how the air-conditioning duct is arranged.

An object of the present invention is to provide a guiding of the air-conditioned fluid flows in the case of a spinning machine of the initially mentioned type in such a manner that they reach the location where they are actually required.

This object is achieved according to preferred embodiments of the invention in such a manner that the outlet openings are arranged such that the fluid flows penetrate the drafting devices.

Since the whole spinning room does not have to be air-conditioned, not only is a low energy consumption achieved according to the invention, but care is also taken that the fluid flows definitely penetrate the drafting devices, for example, the drafting units of ring spinning machines where the air-conditioning is needed most. In addition, in the case of preferred embodiments of the invention, the space requirements for the mounting of the air-conditioning duct are also reduced.

The invention is preferably used particularly in the case of ring spinning machines in which an unutilized space exists below the spindle rail anyhow which may be used for an air-conditioning duct. In an advantageous development of the invention, slivers are fed to a ring spinning machine in cans which are deposited above the spinning machine. These slivers are then fed along a fairly long path to the drafting units from above so that it is particularly important to provide air-conditioning in the area of the drafting units. On their transport path, the slivers are supported by guiding devices, such as transport belts, so that it becomes possible to also feed relatively thin slivers in cans, that is, slivers with sizes of approximately Nm 0.4 to 0.8. By the use of such guiding devices, these fine slivers can also be transported along larger vertical sections. By means of this can feeding, it will then be possible to do without a premounted machine, such as the flyer, in the case of ring spinning machines. At the same time, the previously customary three-cylinder drafting units may still be used.

Other objects, advantages and novel features of the present invention will become apparent from the following detailed description of the invention when considered in conjunction with the accompanying drawings.

DETAILED DESCRIPTION OF THE DRAWINGS

In the individual embodiments, the same reference numbers are used when the same components are involved. Such components are described only once by means of FIG. 1. In addition to the reference numbers, the following letters are used: ZL for incoming air; AL for outgoing air; SA for subjecting the drafting unit to suction; and F for fluid flows.

Figure 1:
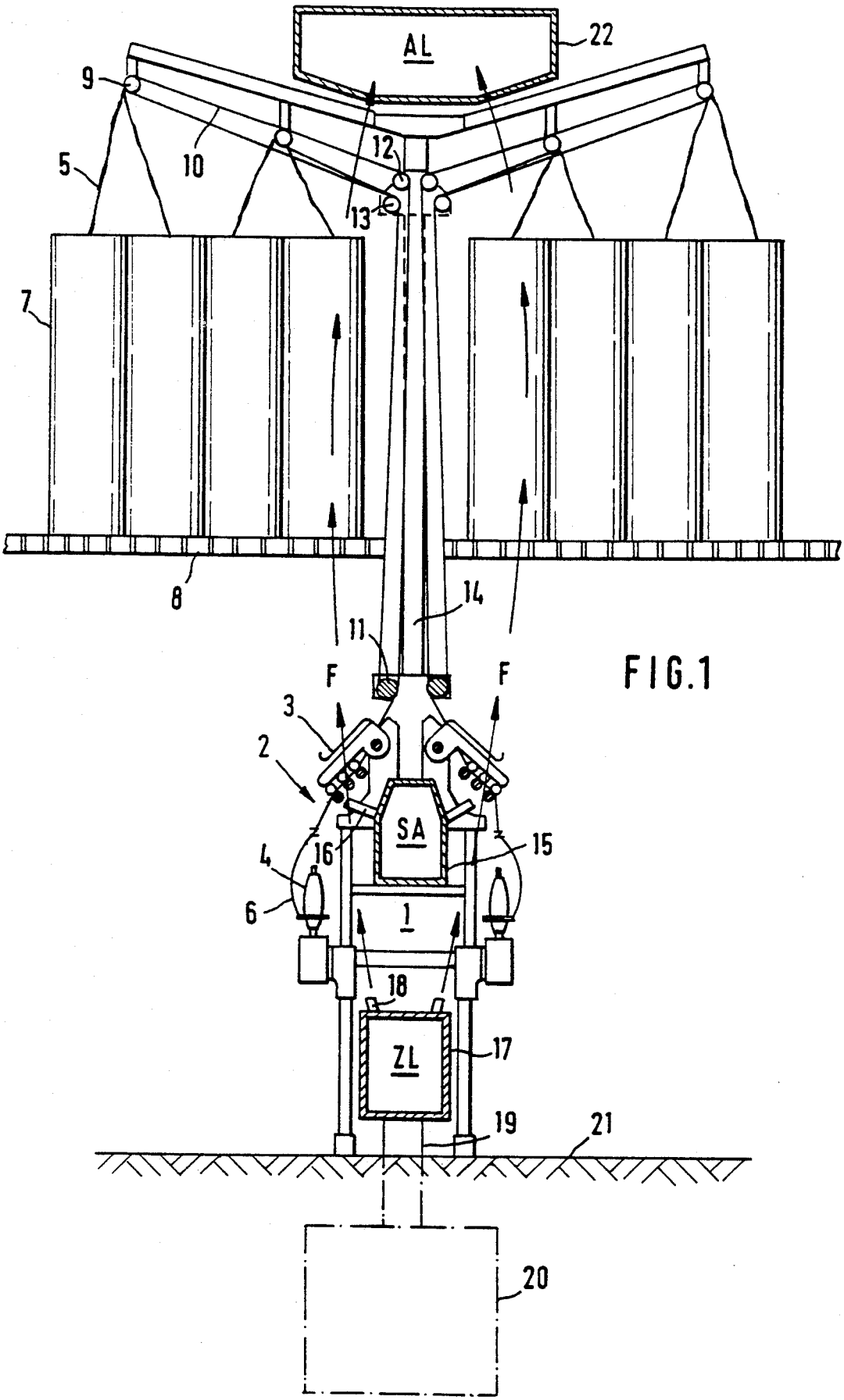
FIG. 1 is a cross-sectional view of a ring spinning machine to which slivers are fed in cans which are deposited on a platform above the spinning machine, having an air-conditioning duct which is integrated into the spinning machine below the spindle rail, constructed according to a preferred embodiment of the invention.

The spinning machine 1 illustrated in FIG. 1 is a ring spinning machine which is provided in a conventional manner on both sides of the machine with a plurality of spinning stations 2 arranged in a row next to one another. Of the spinning stations 2, essentially only the drafting devices constructed as drafting units 3 and the ring spindles 4 are shown. Instead of ring spinning machines, other spinning machines may also be provided, such as open-end rotor spinning machines, open-end friction spinning machines, air spinning machines, wind-around spinning machines or the like. These machines may be equipped with spinning stations on one or both machine sides.

Each of these spinning stations 2 spins a sliver 5 into a yarn 6. The slivers 5 pertaining to the individual spinning stations 2 are fed in cans 7 which are deposited in several rows above the spinning machine on a platform 8. In the representation according to FIG. 1, four rows of cans 7 are assigned to each side of the machine.

By means of withdrawal rollers 9 arranged above the cans 7, the slivers 5 are withdrawn from the cans 7 and, by way of transport belts 10, which are preferably provided with a coating holding the slivers 5, are fed to the individual spinning stations along a long transport path. The transport belts 10 of both machine sides run above the spinning machine 1 in the machine center at a narrow distance next to one another.

In addition to the mentioned withdrawal rollers 9, driving rollers 11 as well as deflection pulleys 12 and 13 are assigned to the transport belts 10. The rollers and pulleys 9, 11, 12 and 13 are fastened to a creel 14 which is mounted on top on the spinning machine 1 and is situated essentially above the platform 8.

So that the air circulation and thus the air-conditioning is impaired as little as possible by the platform 8, the platform 8 is constructed as a largely air-permeable grid construction.

A vacuum duct 15 extends between the drafting units 3 of both machine sides in the longitudinal direction of the machine and has a suction pipe 16 at each spinning station 2 which is aimed against the bottom cylinder of the delivery roller pair of the respective drafting unit 3. In the case of a yarn breakage, this suction pipe 16 temporarily accommodates the continuously delivered sliver 5.

An air-conditioning duct 17 extends below the ring spindles 4 on the inside of the spinning machine 1 in the machine center in the longitudinal direction of the machine and, on the top side, is provided with outlet openings 18 for air-conditioned fluid flows F. Should the cross-section of the air-conditioning duct 17 that can be obtained on the interior of the spinning machine 1 not be sufficient when the machine length is extreme, the air-conditioning duct 17, in a manner that is not shown, can be widened downward into the floor. It may also, as shown by a dash-dotted line, be connected by way of connecting lines 19 to a large-volume supply duct 20 for air-conditioned air placed under the floor.

Figure 8:
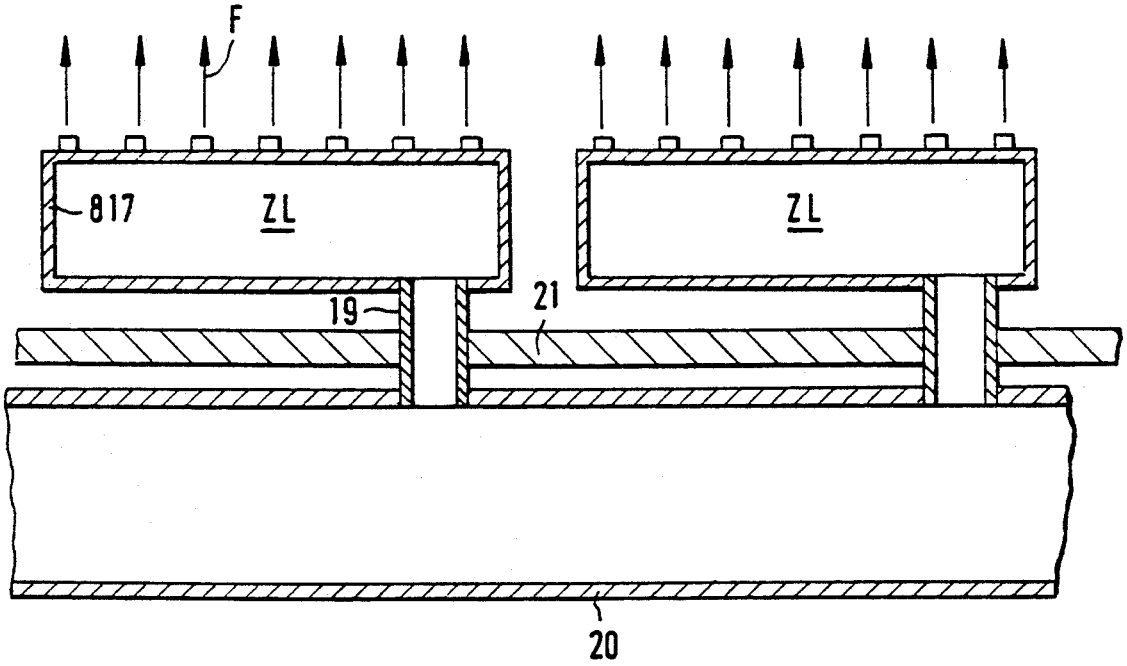
FIG. 8 is a longitudinal sectional view of air-conditioning ducts which are arranged in sections, according to other preferred embodiments of the invention.

The air-conditioning duct 17 extends along the whole length of the spinning machine 1. However, as an alternative, as illustrated in FIG. 8, it may also have the length of a machine section and be supplied by the supply duct 2 placed under the floor 21. FIG. 8 shows all connecting lines 19 which connect the air-conditioning ducts 817 constructed in sections with the supply duct 20.

The air, which flows out of the outlet openings 18 from the air-conditioning duct 17 of FIG. 1, flows upward and sweeps over the operating elements of the individual spinning stations which are relevant to the spinning techniques. In particular, the air-conditioning fluid flows F penetrate the individual drafting units 3, specifically against the travelling direction of the slivers 5. The suction pipes 16 arranged on the delivery rollers receive a portion of the fluid flows coming from the air-conditioning duct 17 and contribute to the fact that the fluid flows F securely reach the drafting units 3.

Above the creel 14, an outgoing-air duct 22 is provided, the bottom side of which is adapted to the contour of the creel 14. Naturally, such a suction duct may also be arranged at a different point.

The housing of the air-conditioning duct 17 inside the spinning machine 1 represents an optimum with respect to the utilization of the space conditions. A free space is utilized here which had been completely unused in the case of ring spinning machines.

Figure 2:
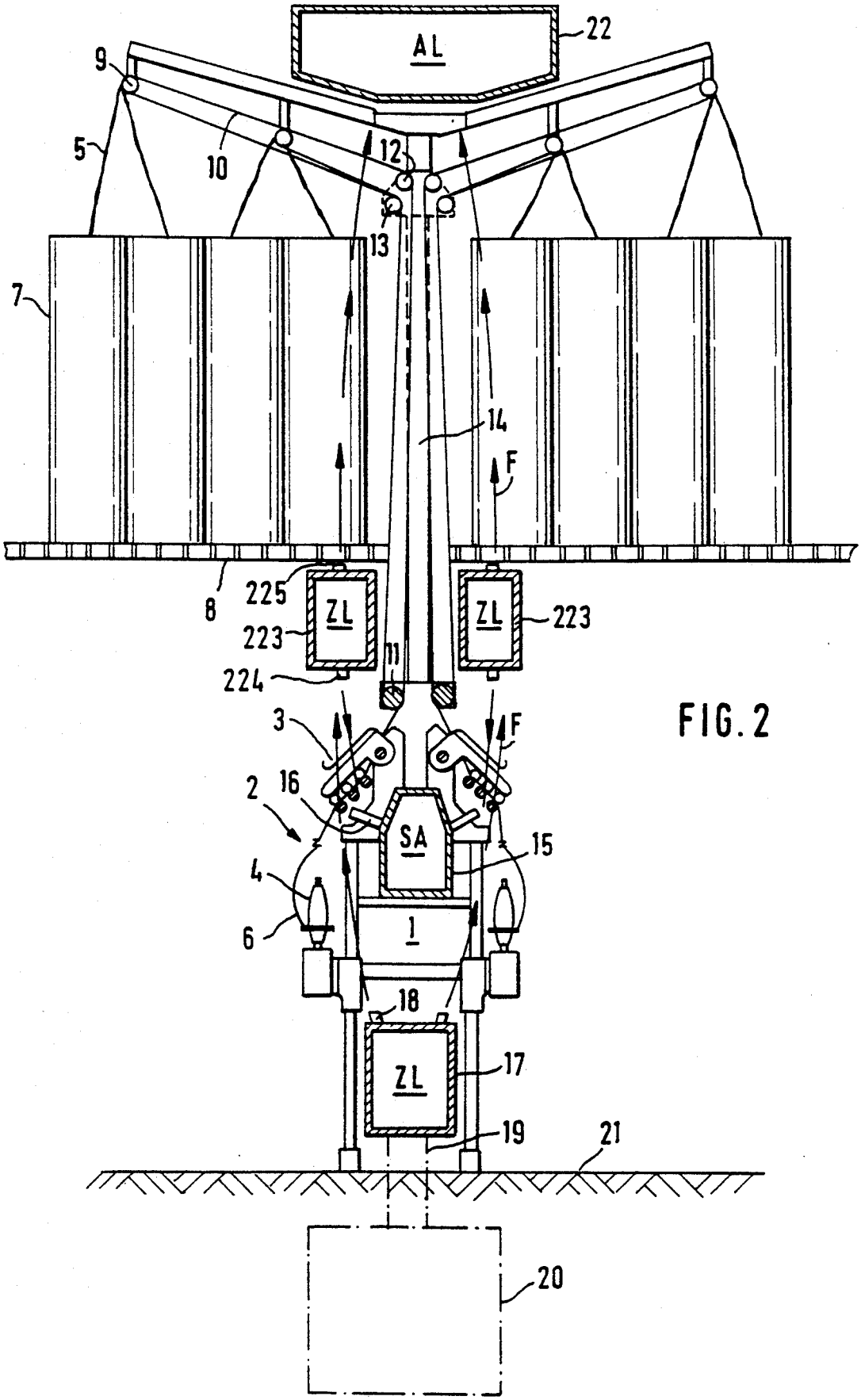
FIGS. 2 to 7 are each cross-sectional views similar to FIG. 1, in which the air-conditioning ducts and/or out-going air ducts which are assigned to them, are arranged in a different manner, according to other preferred embodiments of the invention.

The construction according to FIG. 2 differs from the construction according to FIG. 1 only because of the fact that, above the spinning machine 1 closely under the platform 8, two air-conditioning ducts 223 are provided of which one respectively is assigned to one side of the machine. They are situated in the space closely next to the transport belts 10, the outer contour not projecting or not noteworthily projecting beyond the base area of the spinning machine 1. Air-conditioning ducts 223 exist in addition to the air-conditioning duct 17. The outlet openings 224 of the air-conditioning ducts 223 are also directed such that the outflowing air-conditioned fluid flows F penetrate the drafting units 3.

On this occasion, it should be noted that in the case of all shown outgoing-air ducts (marked AL), the required inlet openings are not shown in the drawings.

The air-conditioning ducts 223, which are additionally shown in FIG. 2, have additional outlet openings 225, which are also directed upward, which are directed through the platform 8, and the fluid flows of which are directed to the outgoing-air duct 22. These fluid flows, which are directed upward above the platform 8, also flow through the area of the cans 7 so that a pre-air-conditioning is achieved for the slivers 5.

Figure 3:
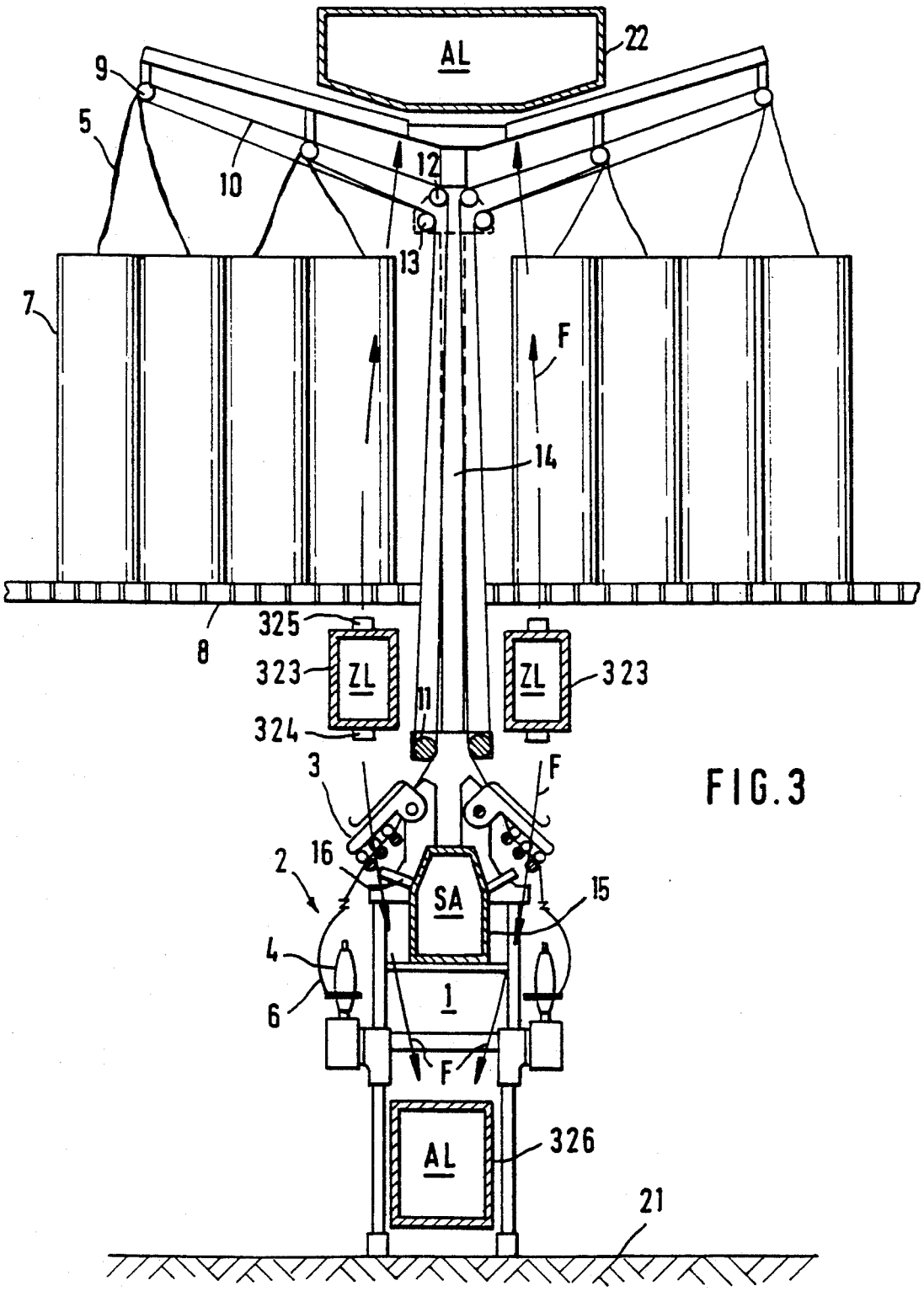

In the embodiment according to FIG. 3, two air-conditioning ducts 323 are arranged at the same point at which the additional air-conditioning ducts 223 according to FIG. 2 were provided. However, in this embodiment, the air-conditioning ducts 323 according to FIG. 3 are the only air-conditioning ducts, in which case the lower outlet openings 324 are again directed such that the fluid flows F penetrate the drafting units 3. In addition, additional fluid flows are directed into the area of the cans 7 through the upwardly directed outlet openings 325.

At that point in the interior of the spinning machine 1 where the air-conditioning duct was situated in the case of the construction according to FIG. 1, in the variant according to FIG. 3, an outgoing-air duct 326 is now accommodated which receives the air-conditioned fluid flows coming from the two air-conditioning ducts 323 through inlet openings which are not shown.

In the embodiment according to FIG. 4, an air-conditioning duct 1 is again provided below the spindles 4 in the interior of the spinning machine 1, as was the case in the variant according to FIG. 1. The fluid flows F flowing out of the outlet openings 18 penetrate the drafting units 3. In addition, above the creel 14, at the point at which in the case of the variant according to FIG. 1, there was an outgoing-air duct 22, an additional air-conditioning duct 427 exists in this case whose outlet openings 428 are directed downward against the cans 7, in which case, at the same time, the slivers 5 are acted upon during their transport.

Figure 4:
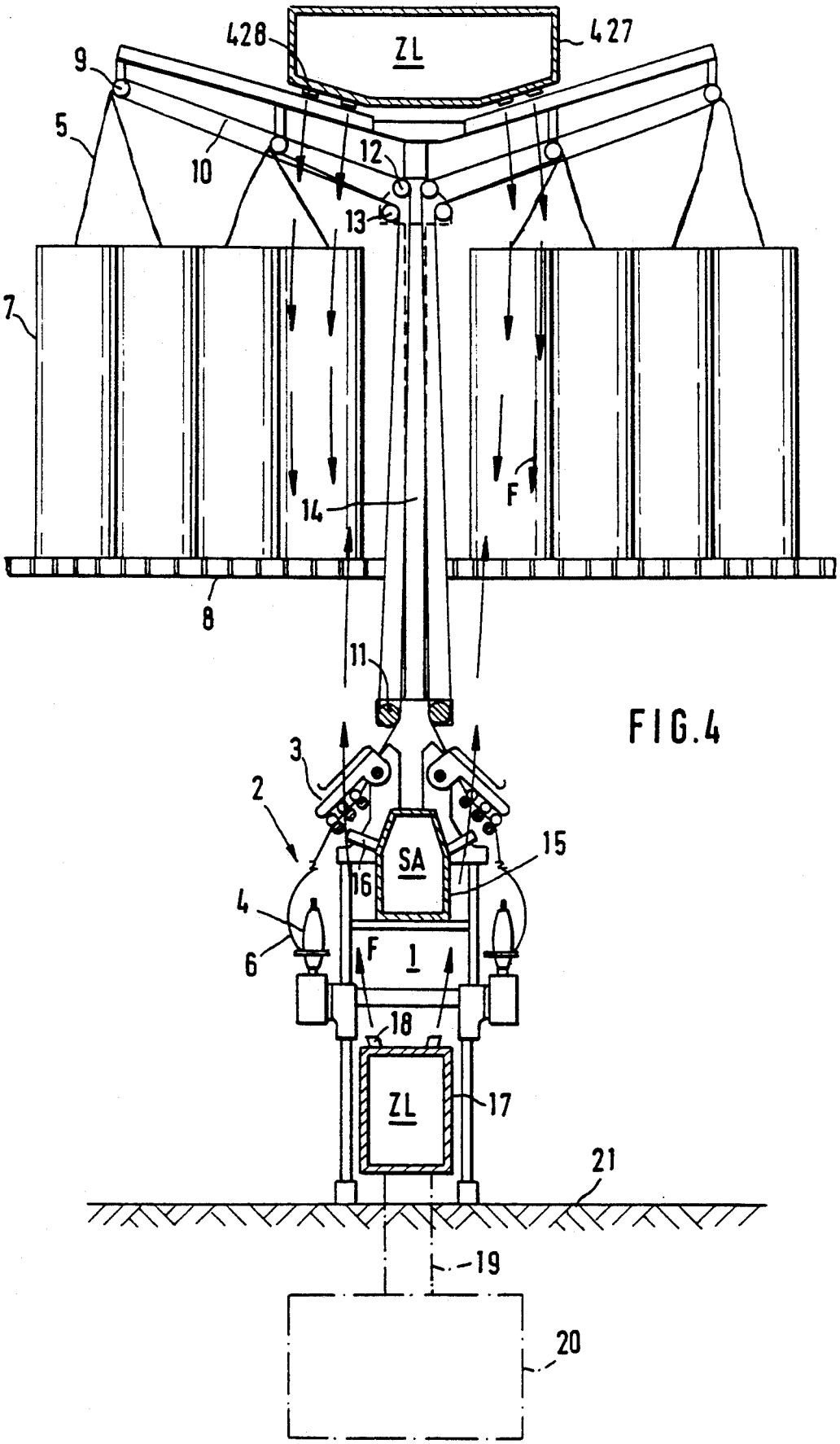
Figure 5:
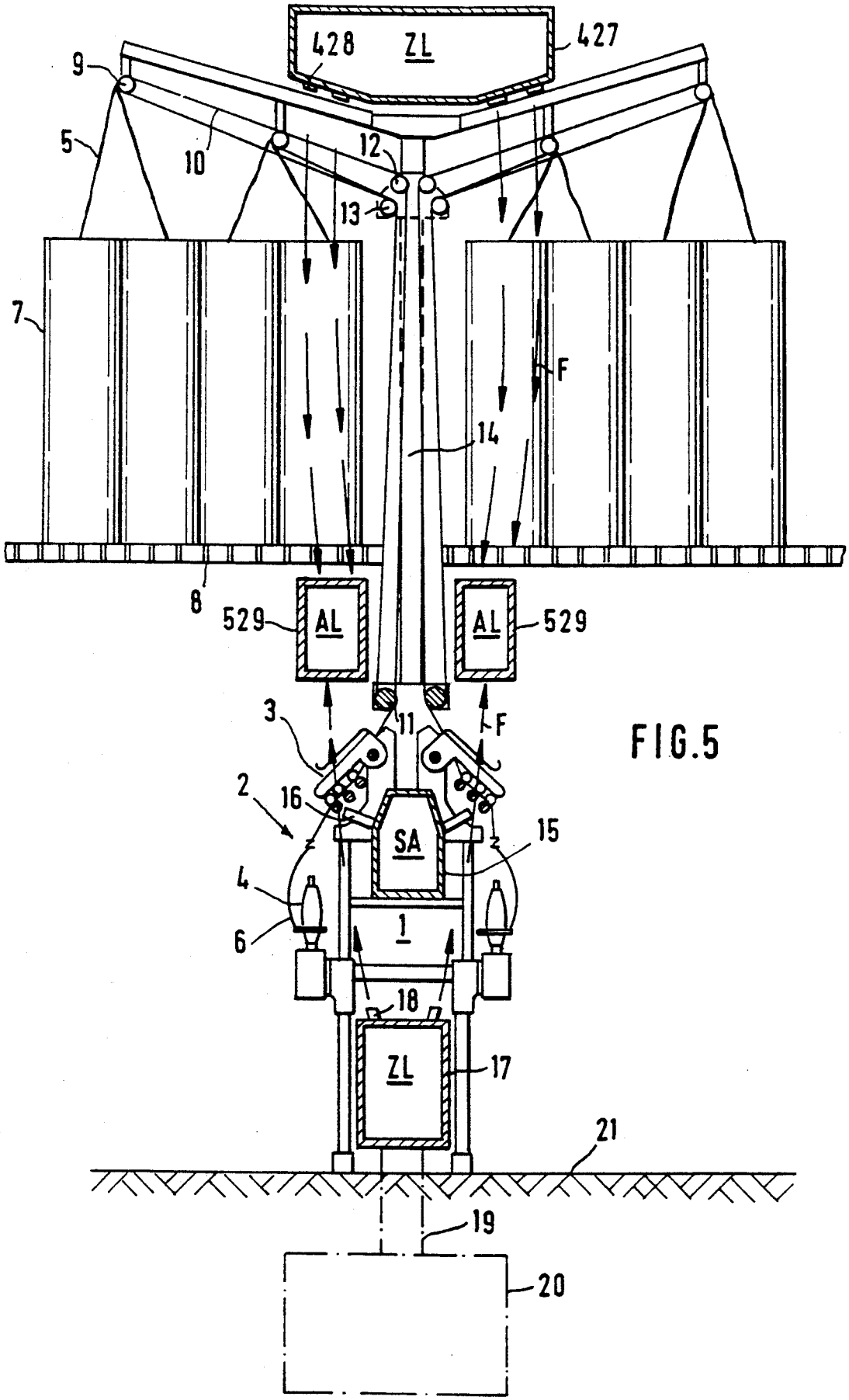

The construction according to FIG. 5 differs from the construction according to FIG. 4 only because of the fact that, at the point at which, according to FIG. 3, the air-conditioning ducts 323 were provided, in this case, two outgoing-air ducts 529 are provided. These outgoing-air ducts 529 receive the air-conditioned fluid flows F of the air-conditioning duct 17, which penetrate the drafting units 3, as well as the fluid flows which flow out through the outlet openings 428 of the additional air-conditioning duct 427.

Figure 6:
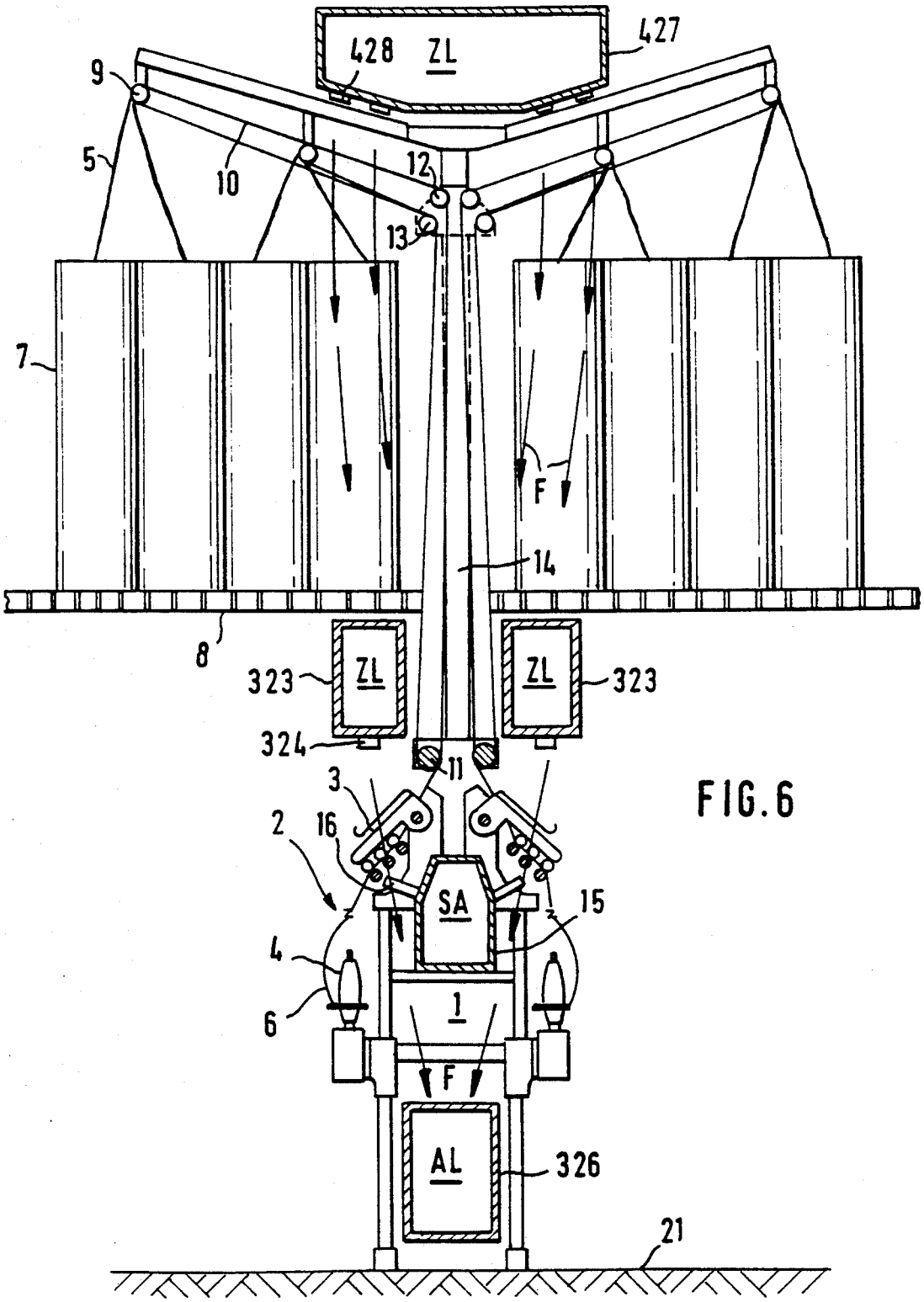

In the case of the construction according to FIG. 6, the air-conditioning ducts 323 are arranged as in FIG. 3. Also, an additional air-conditioning duct 427 exists corresponding to FIG. 5. All fluid flows F, of which a plurality penetrates the drafting units 3, are received by an outgoing-air duct 326 which is arranged below the ring spindles 4 as in the construction according to FIG. 3.

Figure 7:
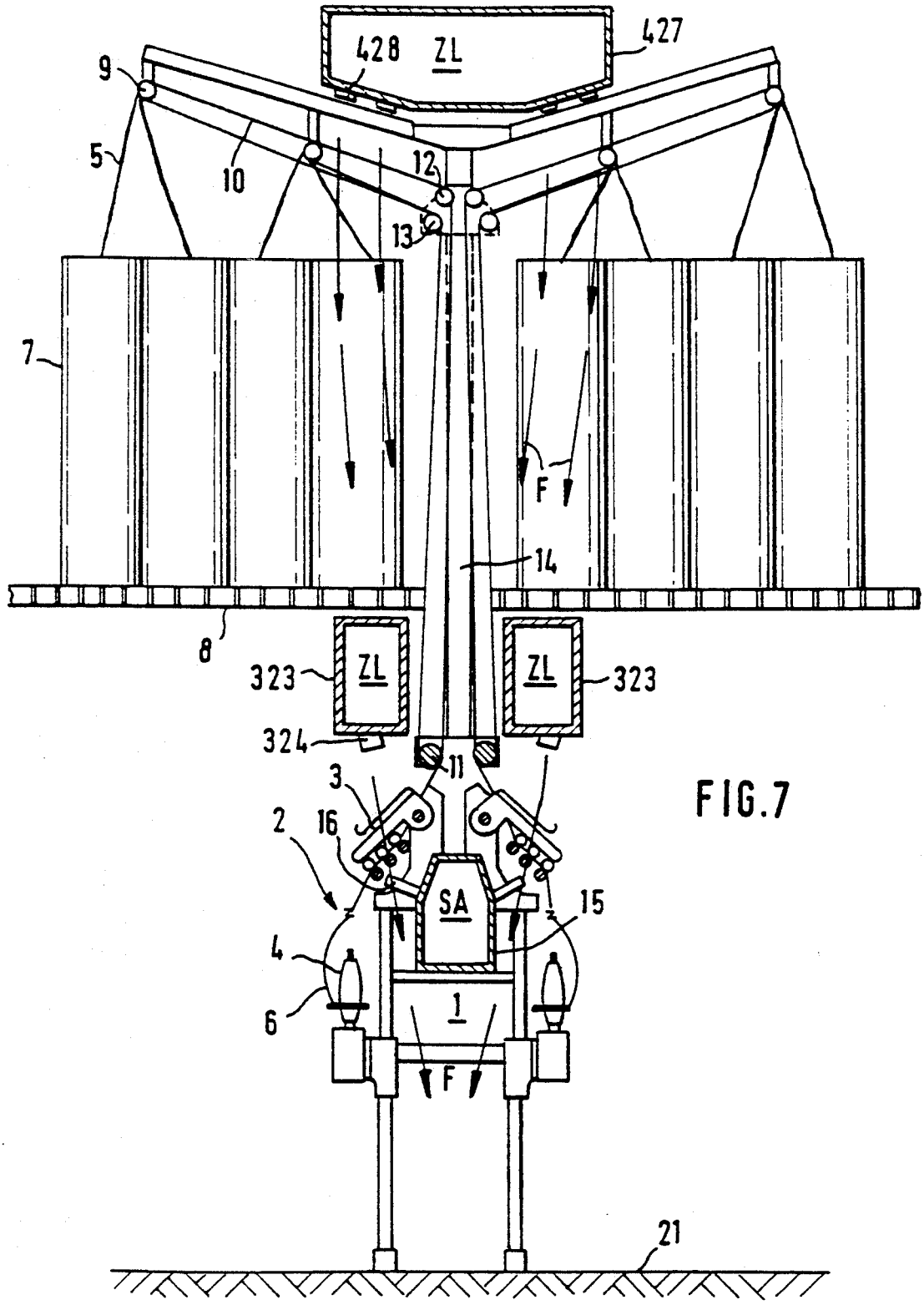

The construction according to FIG. 7 finally completely corresponds to the construction according to FIG. 6, with the only difference that, in the case of the variant according to FIG. 7, there is no outgoing-air duct. However, such an outgoing-air duct may be situated in the area of the supports of the platform 8 under the floor 21 which are not shown.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine located in a spinning room comprising:

a plurality of spinning stations arranged adjacent one another along a longitudinal length of the machine, each spinning station including a drafting device for drafting sliver supplied from a can, said drafting device including drafting rollers, and at least one air-conditioning duct extending in the longitudinal direction of the machine, said at least one air-conditioning duct having outlet openings for air-conditioned fluid flows which are directed such that the air-conditioned fluid flows penetrate the drafting devices, wherein the air-conditioned fluid flows are open to the spinning room.

2. A spinning machine according to claim 1, wherein a vacuum source is assigned to the outlet openings for promoting the penetrating of the drafting devices by the fluid flows.

3. A spinning machine according to claim 2, wherein the at least one air-conditioning duct is arranged in the direct vicinity of the drafting devices.

4. A spinning machine according to claim 2, wherein a separate air-conditioning duct is assigned to each side of the spinning machine and is arranged directly above the pertaining drafting devices.

5. A spinning machine according to claim 2, wherein said at least one air-conditioning duct includes an air-conditioning duct which both sides of the spinning machine have in common and which is arranged below the drafting devices in the area of the machine center.

6. A spinning machine according to claim 2, wherein the at least one air-conditioning duct is composed of sections which are fed by a supply duct arranged outside the spinning machine under the floor.

7. A spinning machine according to claim 2, wherein the cans are deposited above the spinning machine on a platform.

8. A spinning machine according to claim 7, wherein an additional air-conditioning duct is assigned to the cans whose fluid flows follow the transport direction of the slivers.

9. A spinning machine according to claim 1, wherein the at least one air-conditioning duct is arranged in the direct vicinity of the drafting devices.

10. A spinning machine according to claim 9, wherein the at least one air-conditioning duct is composed of sections which are fed by a supply duct arranged outside the spinning machine under the floor.

11. A spinning machine according to claim 1, wherein a separate air-conditioning duct is assigned to each side of the spinning machine and is arranged directly above the pertaining drafting devices.

12. A spinning machine according to claim 1, wherein said at least one air-conditioning duct includes an air-conditioning duct which both sides of the spinning machine have in common and which is arranged below the drafting devices in the area of the machine center.

13. A spinning machine according to claim 10, wherein the fluid flows are opposed to the transport direction of the slivers.

14. A spinning machine according to claim 11, wherein the cans are deposited above the spinning machine on a platform.

15. A spinning machine according to claim 12, wherein an additional air-conditioning duct is assigned to the cans whose fluid flows follow the transport direction of the slivers.

16. A spinning machine according to claim 1, wherein the at least one air-conditioning duct is composed of sections which are fed by a supply duct arranged outside the spinning machine under the floor.

* * * * *